US006145463A

United States Patent [19]

Zeilinger

[11] Patent Number: 6,145,463

[45] Date of Patent: Nov. 14, 2000

[54] FLOAT APPARATUS FOR A FLOATING DOCK

[75] Inventor: Brian Zeilinger, Janesville, Wis.

[73] Assignee: PlayStar, Inc., Janesville, Wis.

[21] Appl. No.: 09/052,691

[22] Filed: Mar. 31, 1998

Related U.S. Application Data

[60] Provisional application No. 60/076,171, Feb. 27, 1998.

[51] Int. Cl.[7] ..... B63B 35/44

[52] U.S. Cl. ..... 114/267; 405/219

[58] Field of Search ..... 114/263, 267, 114/266, 264; 405/219

[56] References Cited

U.S. PATENT DOCUMENTS

| | | | |
|---|---|---|---|
| 4,655,156 | 4/1987 | Svirklys | 114/266 |
| 4,660,495 | 4/1987 | Thompson | 114/263 |
| 4,803,943 | 2/1989 | Corbett | 114/263 |
| 5,183,001 | 2/1993 | Stranzinger | 114/267 |
| 5,199,370 | 4/1993 | Berquist | 114/263 |
| 5,281,055 | 1/1994 | Neitzke et al. | 405/219 |
| 5,404,825 | 4/1995 | McElwain | 114/263 |
| 5,460,114 | 10/1995 | McMillan | 114/267 |
| 5,803,007 | 9/1998 | Stevens | 114/266 |

*Primary Examiner*—Sherman Basinger
*Attorney, Agent, or Firm*—Michael Best & Friedrich LLP

[57] ABSTRACT

A dock system having a float including a top wall. The top wall has a periphery and a central portion spaced from the periphery. The float also has a bottom wall and a continuous side wall connecting the top wall to the bottom wall about the periphery of the top wall. A connection member spaced from said periphery connects the top wall to the bottom wall generally at the central portion, and a deck is connected to said float to form a floating pier or deck.

16 Claims, 7 Drawing Sheets

94
106
46
62
102
90
98
42
122
134
86
76
80
74
84
68
79
66
70

FLOAT APPARATUS FOR A FLOATING DOCK

RELATED APPLICATIONS

This application claims the benefit under 35 U.S.C. §119 of co-pending U.S. Provisional Patent Application Ser. No. 60/076171, filed Feb. 27, 1998.

FIELD OF THE INVENTION

The invention relates to docks, and more particularly, to an improved float for a floating dock.

BACKGROUND OF THE INVENTION

Floating docks are used to moor boats and other water craft and are advantageous where the water level may change because the dock surface will always stay above the water level.

Several different floating dock designs are known. One type of floating dock utilizes a float or float section constructed of a foam, such as styrofoam or a polyurethane foam. However, the foams are generally expensive, break apart, and are environmentally unfriendly.

Another known type of floating dock includes a plurality of float sections and attachable deck sections supported by the float sections. The float sections are molded from a plastic such as, for example, polyethylene, and are usually filled with styrofoam or some other filler material to improve the strength of the float section.

SUMMARY OF THE INVENTION

Hollow plastic float sections or floats placed in water are subject to forces which can cause the float to deform. Therefore, the floats need to have a great deal of strength to resist the deformation. Also, a phenomenon known as oil-canning can occur, wherein the top and bottom walls or side walls of the float are bent (or "popped") inwardly or outwardly as a result of the stress on the float. The repeated stress and strain caused by oil canning can, over time, result in degradation of the float.

It is an advantage of the invention to reduce the occurrence of oil-canning in a semi-rigid float for a dock section.

It is another advantage of the invention to provide a float wherein the top wall and bottom wall are connected to improve the strength of the dock float.

It is another advantage of the invention to provide a dock float having an opening between the top wall and the bottom wall to allow water to drain from the upper surface of the top wall.

It is another advantage of the invention to provide a float having an upper surface that is crowned to facilitate drainage of water from the upper surface of the float.

It is another advantage of the invention to provide a dock float having channels formed in the upper surface of the top wall to facilitate drainage of water from the upper surface thereof.

It is another advantage of the invention to provide an inexpensive and reliable floating dock design.

Other features and advantages of the invention are set forth in the following drawings, description and claims.

Figure 1:
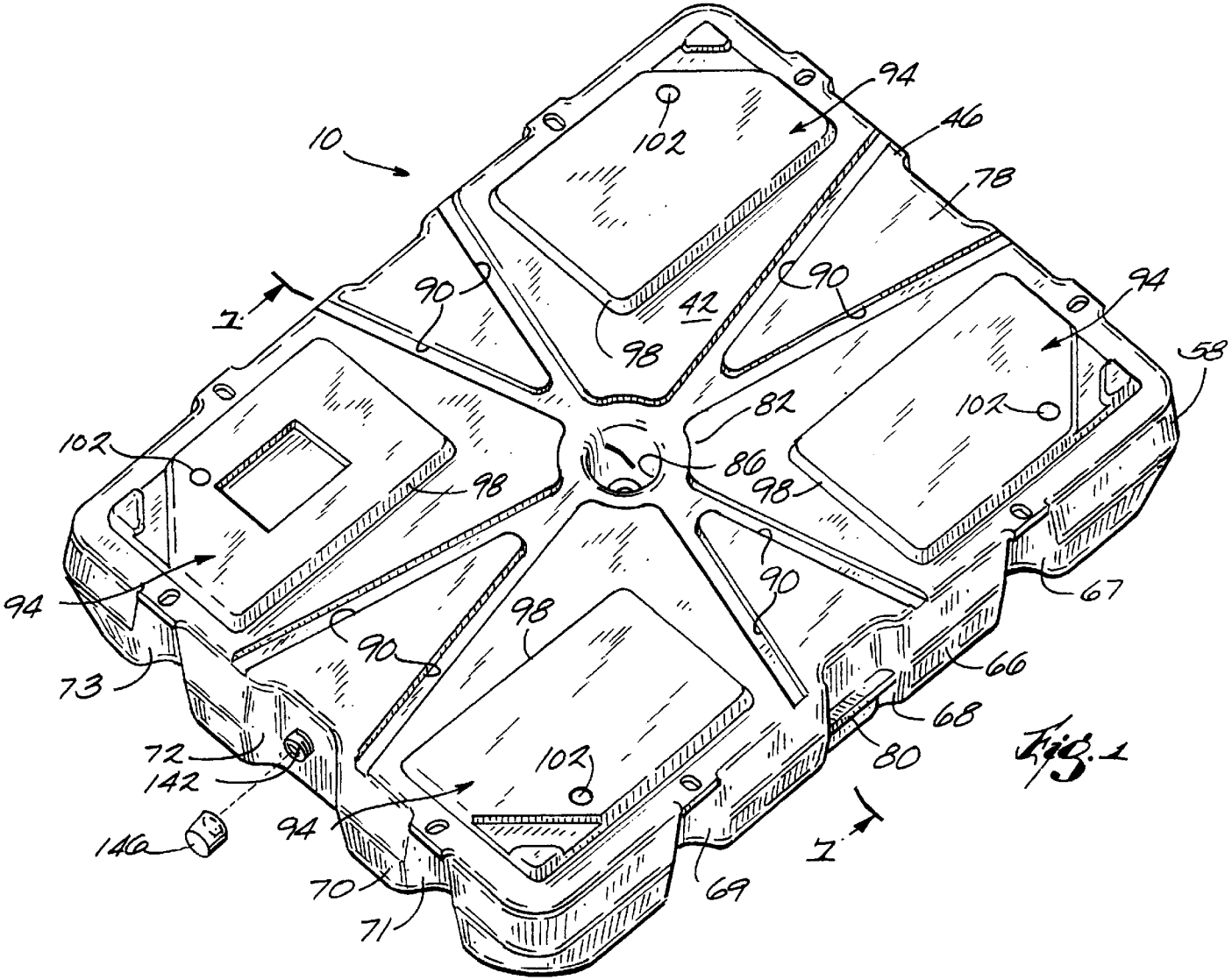
FIG. 1 is a top perspective view of a dock float in accordance with the present invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 of the drawings is a perspective view of a dock float or float section 10 in accordance with the present invention. The dock float 10 is a generally rectangular, hollow, self-floating, one-piece molded section. The dock float 10 can be constructed of any suitable material. In the embodiment shown in the drawings, the dock float 10 is made of a blow molded parasin, such as polyethylene, and in particular, high density, high molecular weight polyethylene.

Figure 7:
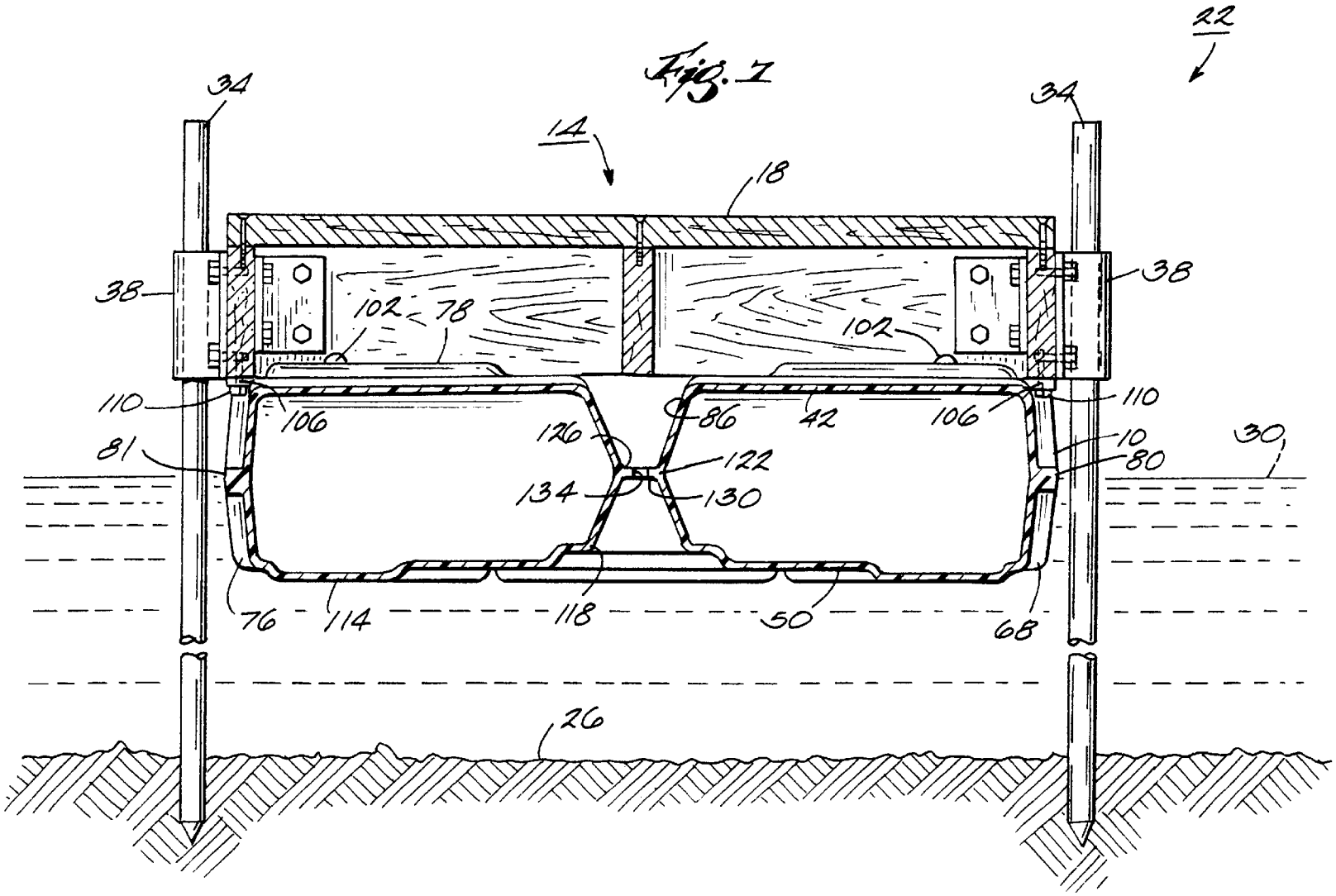
FIG. 7 is a cross-sectional view of the dock float taken along line 7—7 of FIG. 1, but including a deck or dock section attached to the dock float.
Figure 8:
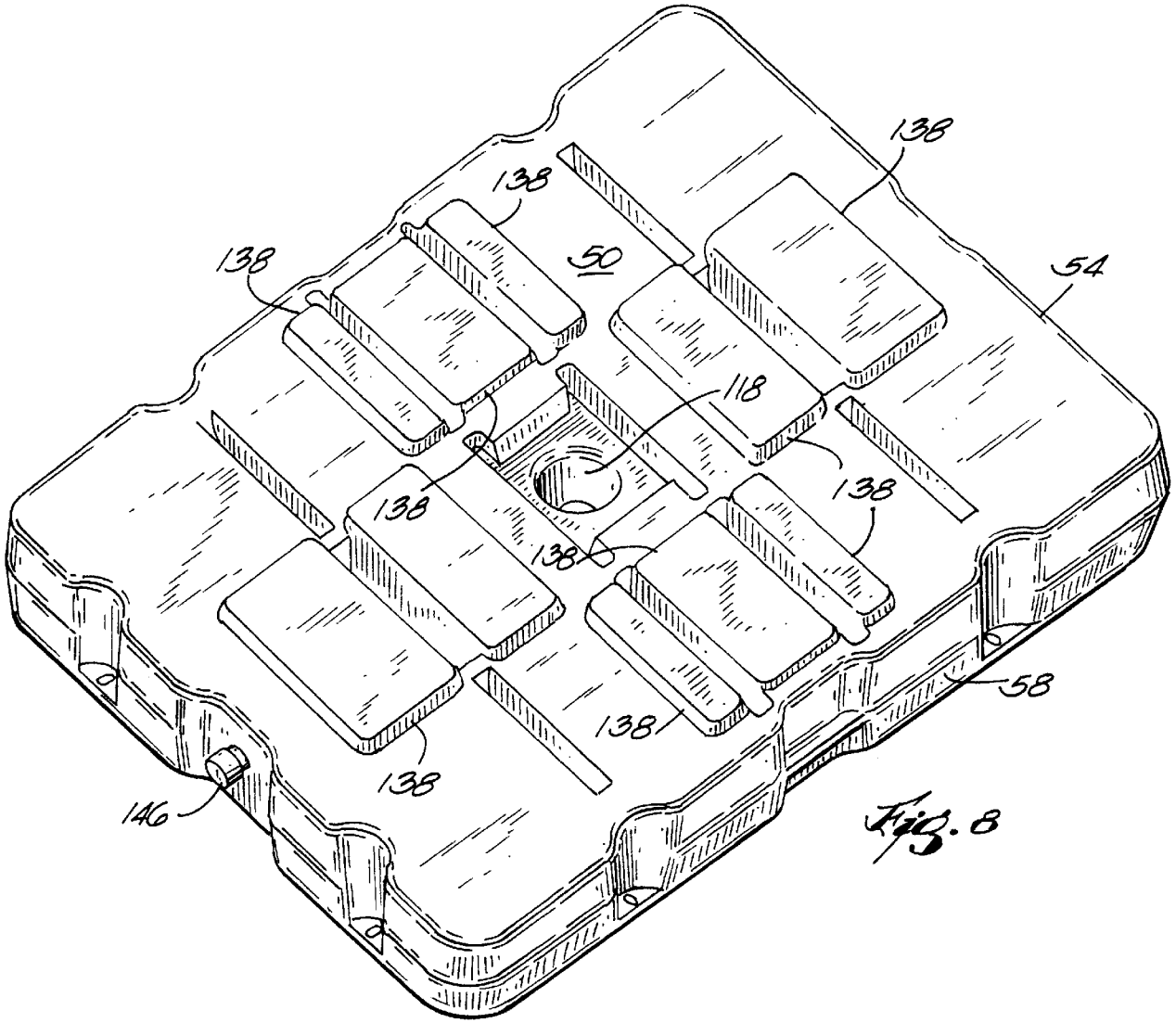
FIG. 8 is a bottom perspective view of a dock float in accordance with the present invention.

As shown in FIG. 7, the dock float 10 is adapted to support a deck or deck section 14 constructed, for example, out of wood planks 18. The deck section 14 is attached to the dock float 10 as shown to create a floating dock 22. The floating dock is typically constructed using a plurality of dock floats 10. While the modular nature of the dock floats 10 permits the floating dock to be constructed of various sizes, in the usual case, three dock floats are used to support a modular deck section that is approximately four feet wide by twelve feet long. As shown in FIG. 7, the floating dock 22 is anchored to the bed 26 beneath the body of water 30 via poles 34 embedded in the bed 26. The deck section 14 is slidably connected to the poles 34 via brackets 38 mounted on the side of the deck section 14.

Figure 2:
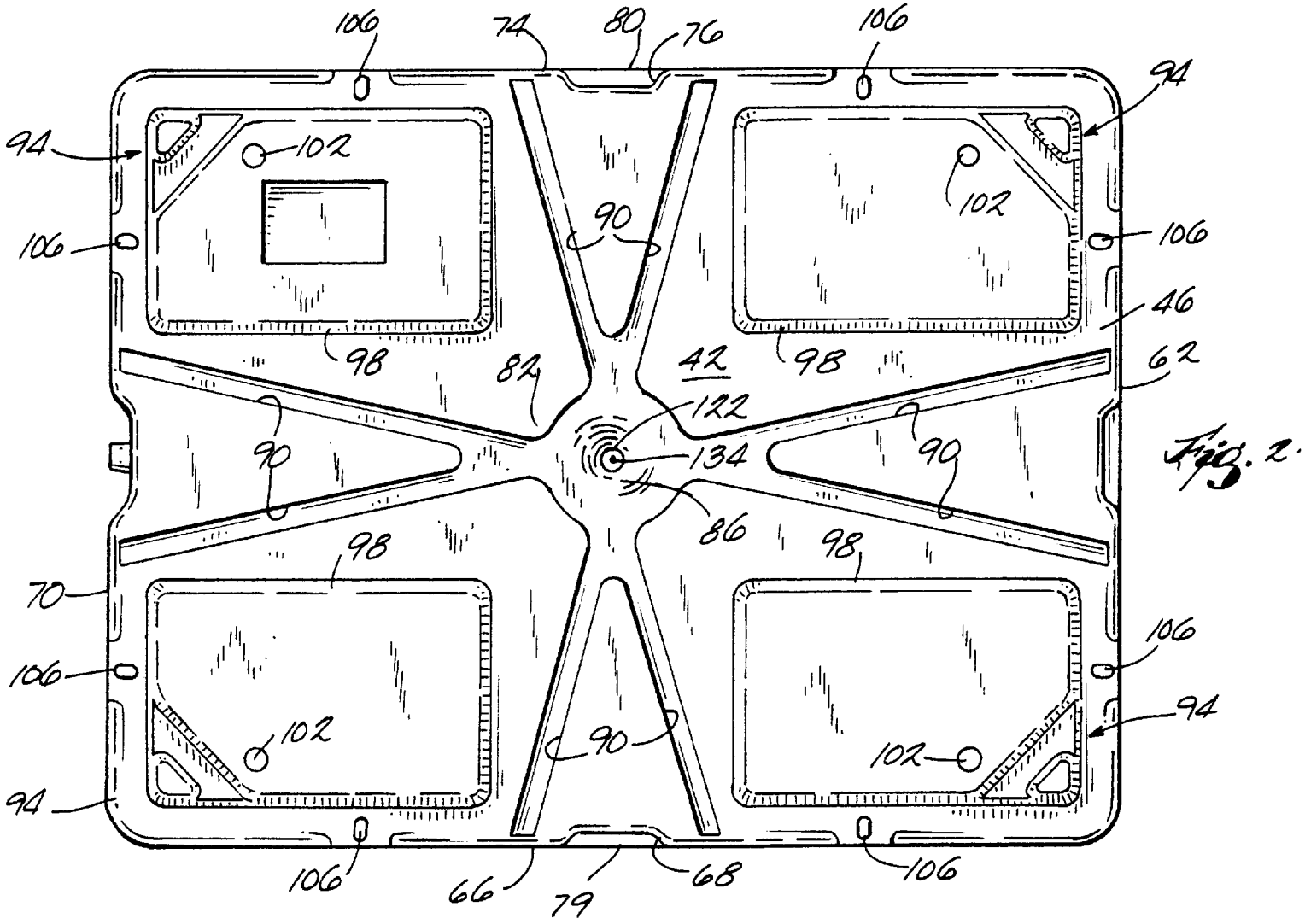
FIG. 2 is a top view of the dock float.
Figure 3:
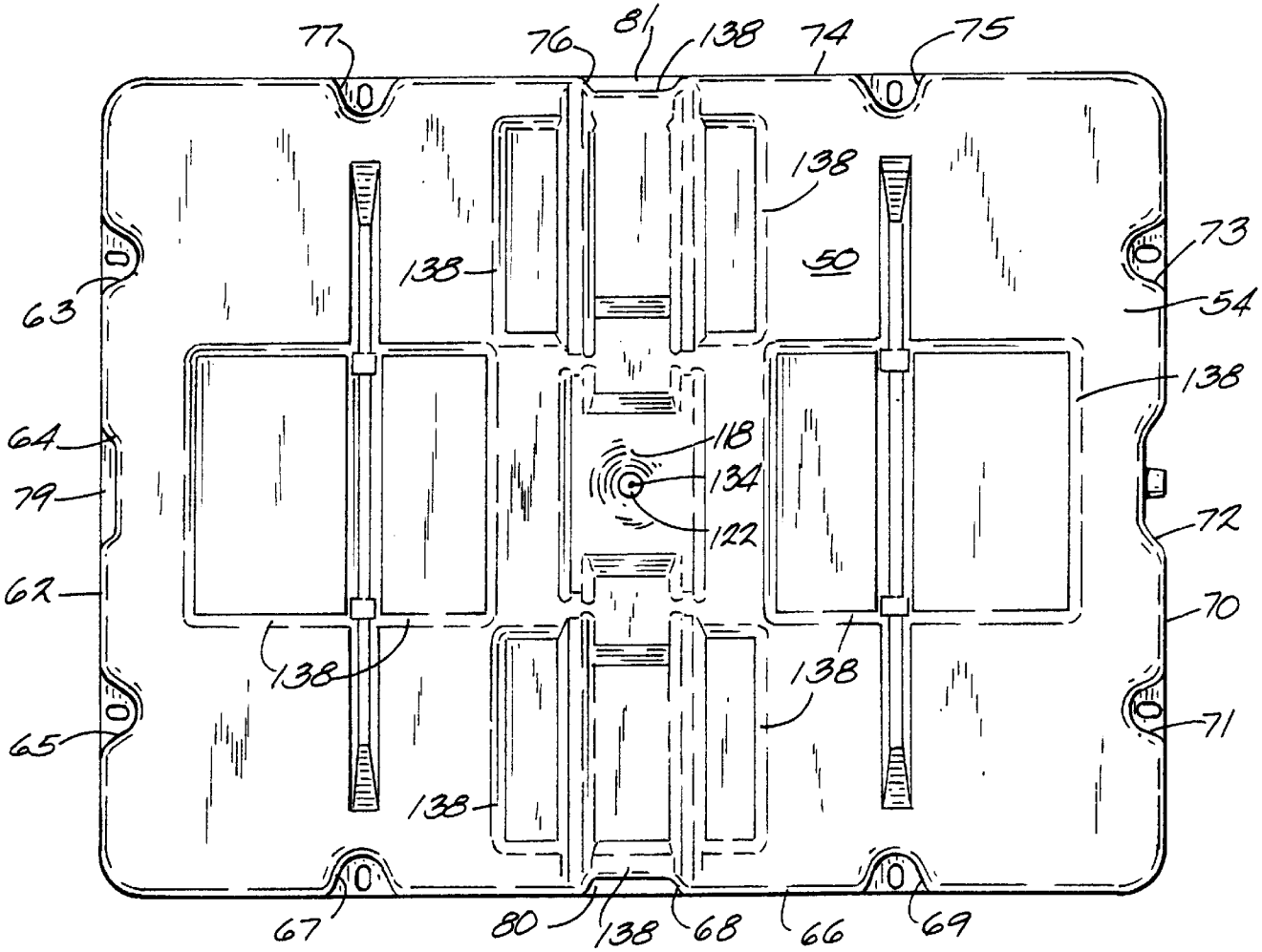
FIG. 3 is a bottom view of the dock float.

Referring to FIGS. 1 and 2, the dock float 10 includes a top wall 42 having a periphery 46, a bottom wall 50 (FIG. 3) having a periphery 54 (FIG. 3) and a continuous side wall 58 connecting the top wall 42 to the bottom wall 50 adjacent the peripheries 46 and 54 to form an interior cavity 60 (FIG. 7). Though any shape may be appropriate, in the preferred embodiment, the side wall 58 defines four sides 62, 66, 70 and 74 so that the dock float 10 (as viewed from the top or bottom) is a generally rectangular or square quadrilateral in shape. The sides 62, 66, 70 and 74, include offset regions 63, 64 and 65; 67, 68 and 69; 71, 72 and 73; and 75, 76 and 77, respectively. The offset regions add stability and strength to the sidewall. As best shown in FIGS. 3 and 7, offset regions 64 (FIG. 3 only), 68 and 76 include strengthening membranes 79, 80 and 81, respectively.

Figure 4:
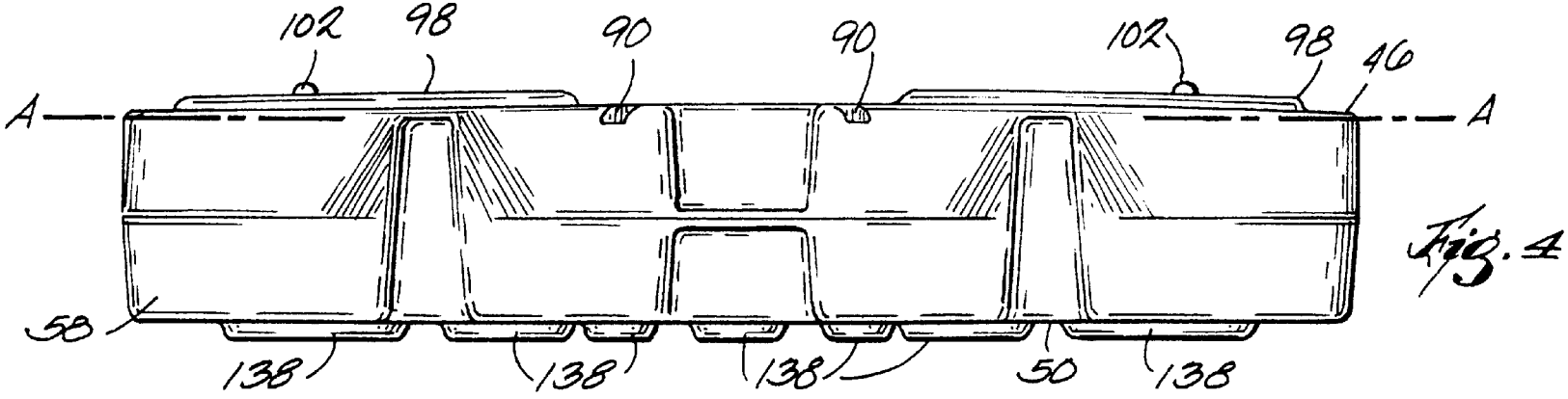
FIG. 4 is a side view of the dock float.
Figure 5:
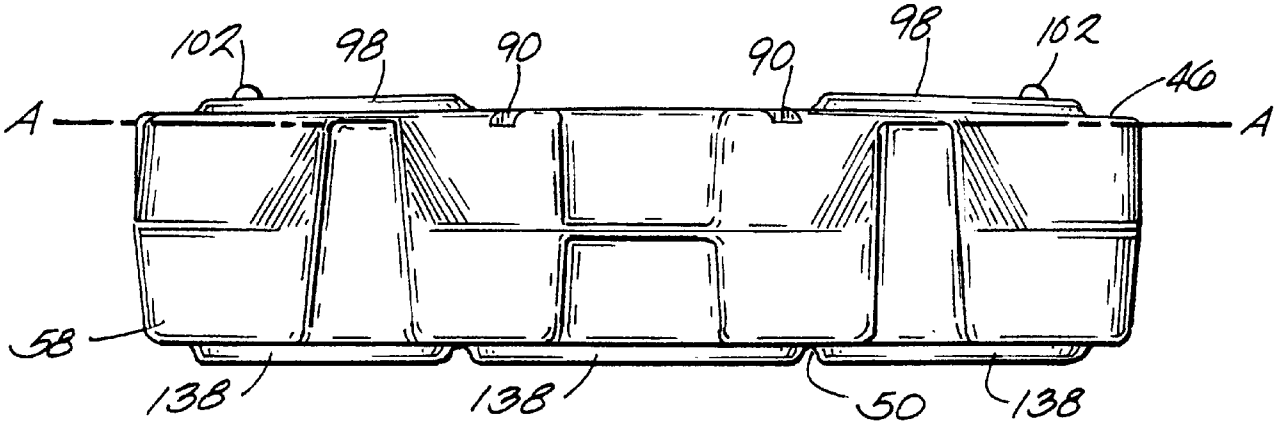
FIG. 5 is a view of a first end of the dock float.
Figure 6:
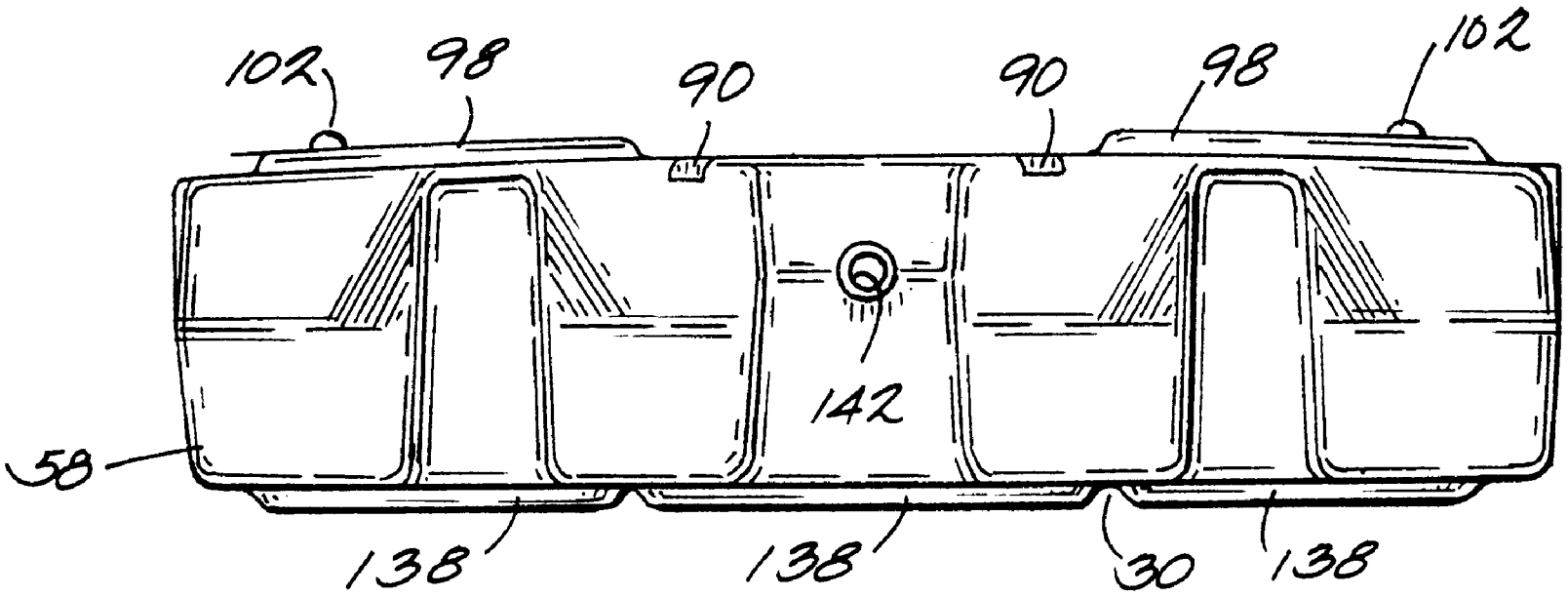
FIG. 6 is a view of a second end of the dock float.

As shown in FIGS. 1 and 7, the top wall 42 includes an upper surface 78 having a generally central portion 82 spaced from the periphery 46. As shown in FIGS. 4 and 5, the top wall 42 is slightly crowned, i.e., the central portion 82 rises above the horizontal plane defined by line A—A extending through the periphery 46 of top wall 42. Referring again to FIG. 1, the upper surface 78 defines within the central portion 82, a generally frustoconical recess 86 extending downwardly from the central portion 82 of the top wall 42 toward the bottom wall 50.

The upper surface 78 also defines a plurality of channels 90 formed therein and extending radially outward from the recess 86 toward the periphery 46 of the top wall 42. The channels 90, in combination with the crowning of the top wall 42, allow water to run off of the upper surface 78 of the dock float 10.

The upper surface 78 also includes four corner portions 94 and defines four elevated plateau-like sections 98, one in each corner portion 94. Each plateau-like section 98 includes a raised nodule 102 extending upwardly from the plateau-like section 98 of the top wall 42. The periphery 46 of the top wall 42 includes a plurality of through-bores 106 for connecting the dock floats 10 to the deck sections 14. While any number of through-bores 106 may be selected, the embodiment shown in the drawings has eight through-bores 106 formed in the periphery 46 of the top wall 42. As shown in FIG. 7, wood screws 110 extend upwardly through the through-bores 106 and into the deck section 14 to secure the deck section 14 to the float 10.

As shown in FIG. 7, the bottom wall 50 includes a lower surface 114 defining a centrally located, generally frustoconical recess 118 located directly below the top wall recess 86 and extending upwardly from the bottom wall 50 toward the top wall 42. Still referring to FIG. 7, the top wall 42 and the bottom wall 50 meet and are fixedly connected to one another adjacent the frustoconical recesses 86 and 118 to form a base wall 122 having a top surface 126 and a bottom surface 130. A hole 134 extends through the base wall 122 from the top surface 126 to the bottom surface 130, thereby connecting the top recess 86 and the bottom recess 118. The hole 134 allows water to drain through the dock float 10 and prevents accumulation of water in the top recess 86. The connection of the top wall 42 to the bottom wall 50 provides structural support to the dock float 10 to improve the strength thereof, and reduces the tendency of both the top wall 42 and bottom wall 50 from oil-canning, i.e. bowing or popping inwardly and outwardly in response to the external stresses placed on the dock float 10. While, in the embodiment shown in the drawings, the connection of the top wall 42 and bottom wall 50 is centered within the central portion, in other embodiments (not shown) the connection can be located anywhere within the central portion as long as it operates to prevent "oil-canning" of the top wall 42 and the bottom wall 50. Moreover, though only one connection is shown, in other embodiments (not shown) multiple connections may be used and positioned in various places, again, with the goal of preventing "oil-canning." In still other embodiments, the connection between the top wall and bottom wall need not be in the form of recesses that meet, but rather may include a connection member of any sort formed between the top wall 42 and the bottom wall 50.

As shown in FIG. 3, the lower surface 114 of the bottom wall 50 also includes plateau-like sections 138 that are complementary to the plateau-like sections 98 formed in the upper surface 78 of the top wall 42. The complementary fit between the upper and lower surface plateau-like sections 98 and 114 allows the floats 10 to be stacked during shipping or storage without having the floats 10 slide relative to one another. The nodules 102 provide additional stability by reducing rocking or tippage of the stacked float sections. Such rocking or tippage may otherwise result from the crowning of the top wall 42.

The continuous side wall 58 includes a circular opening 142 that extends through the side wall 58 into the interior cavity 60 of the dock float 10. A plug 146 is mounted on the opening 142 to seal the dock float 10. Any method of securing the plug 146 to the dock float 10 is appropriate as long as a seal is created to prevent water from entering the interior cavity 60 of the dock float 10. In the embodiment shown in the drawings, the plug 146 is a self-threading plug that is screwed onto the lip of the circular opening 142 to seal the opening 142.

Various other features and advantages of the invention are set forth in the following claims.

What is claimed is:

1. A float for a floating dock, said float comprising:

a top wall having a periphery and a center;

a bottom wall;

a continuous side wall connecting said top wall to said bottom wall about said periphery of said top wall; and a connection member spaced from said periphery and connecting said top wall to said bottom wall generally at said center, wherein said connection member includes a recessed wall formed in said center and connected to said bottom wall, said recessed wall includes a base extending inward from said recessed wall and forming a water drainage hole.

2. A float as set forth in claim 1 wherein said recessed wall is generally frustoconical.

3. A float as set forth in claim 1 wherein said top wall is crowned adjacent said center.

4. A float as set forth in claim 3 wherein said top wall includes drainage channels formed in said top wall and extending radially from said recessed wall.

5. A float as set forth in claim 1 wherein said top wall, bottom wall and side wall are constructed of polyethylene.

6. A float for a floating dock, said float comprising:

a top wall having a periphery, a center and a recess formed in said center, wherein said top wall is crowned adjacent said center such that said top wall slopes downwardly from said center toward said periphery;

a bottom wall having a periphery, a center, and an upwardly extending recess formed in the center, said bottom wall being connected adjacent said recess to said top wall; and a continuous side wall connecting said top wall periphery to said bottom wall periphery to form an interior surface defining a cavity.

7. A float as set forth in claim 6 including a common base wall between said top wall recess and said bottom wall recess.

8. A float as set forth in claim 7 wherein said base wall includes a drainage hole.

9. A float as set forth in claim 6 wherein said top recess is generally frustoconical.

10. A float as set forth in claim 6 wherein said bottom recess is generally frustoconical.

11. A float as set forth in claim 6 wherein said top wall includes drainage channels formed therein and extending radially outward from said center.

12. A float as set forth in claim 6 wherein said float is molded from polyethylene.

13. A dock system comprising:

a float including a top wall having a periphery and a central portion spaced from said periphery, a bottom wall, a continuous side wall connecting said top wall to said bottom wall about said periphery of said top wall, and a connection member spaced from said periphery and connecting said top wall to said bottom wall generally at said central portion, wherein said connection member includes a recessed wall formed in said central portion and connected to said bottom wall, said recessed wall includes a base extending inward from said recessed wall and forming a water drain hole, and wherein said top wall includes drainage channels formed in sad top wall and extending radially away from said recessed wall; and a deck connected to said float.

14. A float as set forth in claim 13 wherein said recessed wall is generally frustoconical.

15. A float as set forth in claim 13 wherein said top wall is crowned adjacent said central portion.

16. A float as set forth in claim 13 wherein said top wall, bottom wall and side wall are constructed of polyethylene.

* * * * *